US010347063B1

(12) United States Patent
LaRovere et al.

(10) Patent No.: US 10,347,063 B1
(45) Date of Patent: Jul. 9, 2019

(54) AUTHORIZED SMART ACCESS TO A MONITORED PROPERTY

(71) Applicant: Alarm.com Incorporated, Tysons, VA (US)

(72) Inventors: Nicholas Frank LaRovere, Washington, DC (US); Matthew Daniel Correnti, Reston, VA (US); Abraham Joseph Kinney, Vienna, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 15/908,397

(22) Filed: Feb. 28, 2018

Related U.S. Application Data

(60) Provisional application No. 62/465,471, filed on Mar. 1, 2017.

(51) Int. Cl.
*G07C 1/10* (2006.01)
*G07C 1/32* (2006.01)
*G07C 9/00* (2006.01)

(52) U.S. Cl.
CPC ..... *G07C 9/00158* (2013.01); *G07C 1/10* (2013.01); *G07C 1/32* (2013.01); *G07C 9/00174* (2013.01)

(58) Field of Classification Search
CPC ..... G07C 9/00158; G07C 1/10; G07C 1/32; G07C 9/00174; G07C 9/00031;
(Continued)

(56) References Cited

U.S. PATENT DOCUMENTS 6,971,029 B1 * 11/2005 Avery, IV ..... G06F 21/32 340/5.5
7,116,211 B1 * 10/2006 Parker ..... G06Q 10/02 340/5.33

(Continued)

FOREIGN PATENT DOCUMENTS

WO 2004077848 1/2005
WO 2009088901 7/2009

OTHER PUBLICATIONS

U.S. Non-Final Office Action for U.S. Appl. No. 13/284,323 dated Apr. 11, 2014, 25 pages.

(Continued)

*Primary Examiner* — Edwin C Holloway, III
(74) *Attorney, Agent, or Firm* — Fish & Richardson P.C.

(57) ABSTRACT

A method includes, receiving a biometric identifier from a visitor to the property, determining an arrival time of the visitor based on receiving the biometric identifier, comparing the arrival time of the visitor to an expected arrival time of an expected visitor, based on comparing the arrival time of the visitor to an expected arrival time, transmitting the biometric identifier and data identifying the expected visitor, receiving, by the monitoring system and from the external server, (i) data indicating that the biometric identifier corresponds to the expected visitor and (ii) data indicating that an electronic device of the expected visitor is located at the property, and based on (i) the data indicating that the biometric identifier corresponds to the expected visitor and (ii) the data indicating that the electronic device of the expected visitor is located at the property, granting, by the monitoring system, the visitor access to the property.

20 Claims, 5 Drawing Sheets

(58) Field of Classification Search
CPC ..... G07C 9/00071; G07C 9/00103; G07C 9/00563; G07C 9/00904; G07C 2209/08
USPC ..... 340/5.2, 5.28, 5.52, 5.53, 4.6, 4.61, 4.62
See application file for complete search history.

(56) References Cited

U.S. PATENT DOCUMENTS

| | | | | |
|---|---|---|---|---|
| 7,170,998 | B2 | 1/2007 | Mclintock | |
| 7,196,610 | B2 | 3/2007 | Straumann et al. | |
| 8,437,740 | B2 | 5/2013 | Despain et al. | |
| 8,957,757 | B1 | 2/2015 | Burge et al. | |
| 9,230,374 | B1 | 1/2016 | Burge et al. | |
| 9,514,584 | B1 | 12/2016 | Burge et al. | |
| 2002/0099945 | A1 | 7/2002 | Mclintock et al. | |
| 2003/0151493 | A1 | 8/2003 | Straumann et al. | |
| 2004/0022422 | A1* | 2/2004 | Yamauchi | G06Q 10/08 382/115 |
| 2004/0219903 | A1 | 11/2004 | Despain et al. | |
| 2007/0096870 | A1 | 5/2007 | Fisher | |
| 2007/0193834 | A1* | 8/2007 | Pai | G06Q 10/08 186/3 |
| 2007/0273474 | A1* | 11/2007 | Levine | G05B 15/02 340/5.28 |
| 2007/0290797 | A1 | 12/2007 | Harkins et al. | |
| 2008/0246587 | A1 | 10/2008 | Fisher | |
| 2009/0299777 | A1* | 12/2009 | Silberman | G06Q 10/02 705/5 |
| 2010/0283579 | A1 | 11/2010 | Kraus et al. | |
| 2011/0053557 | A1 | 3/2011 | Despain et al. | |
| 2012/0280783 | A1* | 11/2012 | Gerhardt | G07C 9/00309 340/5.6 |
| 2013/0229259 | A1* | 9/2013 | Huang | G07C 9/00563 340/5.52 |
| 2014/0253285 | A1* | 9/2014 | Menzel | G07C 9/00023 340/5.7 |
| 2015/0194000 | A1* | 7/2015 | Schoenfelder | G07C 9/00309 340/5.61 |

OTHER PUBLICATIONS

U.S. Non-Final Office Action for U.S. Appl. No. 14/622,209 dated Mar. 30, 2015, 16 pages.
U.S. Notice of Allowance for U.S. Appl. No. 13/284,323 dated Dec. 4, 2014, 9 pages.
U.S. Notice of Allowance for U.S. Appl. No. 14/622,209 dated Nov. 12, 2015, 11 pages.
U.S. Non-Final Office Action for U.S. Appl. No. 14/987,200 dated Feb. 10, 2016, 17 pages.
U.S. Final Office Action for U.S. Appl. No. 14/987,200 dated Aug. 10, 2016, 15 pages.
U.S. Notice of Allowance for U.S. Appl. No. 14/987,200 dated Oct. 26, 2016, 8 pages.

* cited by examiner

AUTHORIZED SMART ACCESS TO A MONITORED PROPERTY

CROSS REFERENCE TO RELATED APPLICATIONS

This application claims benefit of U.S. Provisional Application No. 62/465,471, filed Mar. 1, 2017, and titled "Authorized Smart Access to a Monitored Property," which is incorporated by reference in its entirety.

TECHNICAL FIELD

This disclosure relates to property monitoring technology and, for example, controlling access to an unattended monitored property by service providers.

BACKGROUND

Many people equip homes and businesses with monitoring systems to provide increased security for their homes and businesses.

SUMMARY

Techniques are described for monitoring technology. For example, techniques are described for controlling access to an unattended monitored property by service vendors. As another example, these techniques may be used for controlling access to an attended smart property by any human or non-human service provider. The process involves a three factor authentication before a vendor is allowed access to the monitored property.

According to an innovative aspect of the subject matter described in this application, a monitoring system that is configured to monitor a property, the monitoring system includes one or more sensors that are located at the property, and a monitor control unit. The monitor control unit is configured to receive, from one of the one or more sensors, a biometric identifier from a visitor to the property, determine an arrival time of the visitor based on receipt of the biometric identifier, compare the arrival time of the visitor to an expected arrival time of an expected visitor, based on comparison of the arrival time of the visitor to the expected arrival time, transmit, to an external server, the biometric identifier and data identifying the expected visitor, receive, from the external server, (i) data indicating that the biometric identifier corresponds to the expected visitor and (ii) data indicating that an electronic device of the expected visitor is located at the property, and based on (i) the data indicating that the biometric identifier corresponds to the expected visitor and (ii) the data indicating that the electronic device of the expected visitor is located at the property, grant the visitor access to the property.

These and other implementations each optionally include one or more of the following optional features. The monitor control unit is configured to receive data identifying an area of the property that the visitor is restricted from entering while the visitor is inside the property, determine, based on data received from the one or more sensors, that the visitor entered the area of the property that the visitor is restricted from entering, and in response to determining that the visitor entered the area of the property that the visitor is restricted from entering, transmit, to a computing device of a resident of the property, a notification indicating that the visitor entered the area of the property that the visitor is restricted from entering.

The monitor control unit is configured to determine, based on data received from the one or more sensors, that an entry point to the property is closed, based on determining that the entry point to the property is closed, receive data indicating a location of an electronic device of the visitor, determine that the location of the electronic device of the visitor is outside of a threshold distance from the property, and based on determining the location of the electronic device of the visitor is outside of the threshold distance from the property, arm the monitoring system. The monitor control unit is configured to generate an exit code in response to granting the visitor access to the property, communicate the exit code to the visitor, receive the exit code, and based on receiving the exit code, arm the monitoring system and invalidate the exit code for subsequent uses.

The monitor control unit is configured to receive data that indicates a time period for the expected visitor to have access to the property, determine that the time period for the expected visitor to have access to the property has elapsed since granting the visitor access to the property, based on determining that the time period for the visitor to have access to the property has elapsed since granting the visitor access to the property, receive data indicating a location of an electronic device of the visitor, determine that the location of the electronic device of the visitor is outside of a threshold distance of the property, and based on determining that the location of the electronic device of the visitor is outside of the threshold distance of the property, arm the monitoring system.

The monitor control unit is configured to receive data that indicates a time period for the expected visitor to have access to the property, determine that the time period for the expected visitor to have access to the property has elapsed since granting the visitor access to the property, based on determining that the time period for the visitor to have access to the property has elapsed since granting the visitor access to the property, receive data indicating a location of an electronic device of the visitor, determine that the location of the electronic device of the visitor is within a threshold distance of the property, and based on determining that the location of the electronic device of the visitor is within the threshold distance of the property, generate a notification indicating that the visitor is within or near the property for longer than expected. The monitor control unit is configured to transmit, to a computing device of a resident of the property, the notification indicating that the visitor is within or near the property for longer than expected. The monitor control unit is configured to generate a notification indicating that the visitor is within or near the property for longer than expected by outputting an audible alarm.

The monitor control unit is further configured to receive data identifying the expected visitor and the expected arrival time of the expected visitor, communicate, to the external server, data indicating that monitoring system is configured to grant access to the expected visitor upon verification from the external server, receive, from the external server, data indicating that external server is configured to verify a captured biometric identifier of the expected visitor, and transmit, to the external server, the biometric identifier and data identifying the expected visitor based on receiving the data indicating that third-party server is configured to verify a captured biometric identifier of the expected visitor. The monitor control unit is configured to grant the visitor access to the property by disarming the monitoring system and unlocking an entry point to the property.

The monitoring system further includes a monitoring server that is configured to communicate with the external server and the monitor control unit. The monitoring server is configured to receive, from the external server, (i) the data indicating that the biometric identifier corresponds to the expected visitor and (ii) the data indicating that an electronic device of the expected visitor is located at the property, and transmit, to the monitor control unit, (i) the data indicating that the biometric identifier corresponds to the expected visitor and (ii) the data indicating that an electronic device of the expected visitor is located at the property.

The monitoring control unit is further configured to receive, from the external server, (i) data indicating that the biometric identifier does not correspond to the expected visitor and (ii) data indicating that an electronic device of the expected visitor is located at the property, and based on the (i) data indicating that the biometric identifier does not correspond to the expected visitor and (ii) the data indicating that the electronic device of the expected visitor is located at the property, provide, to a client device of a resident of the property, a notification (i) that indicates the biometric identifier does not correspond to the expected visitor and the electronic device of the expected visitor is located at the property and (ii) that includes a selectable option to grant the visitor access to the property. The monitoring control unit is configured to receive, from the client device of the resident of the property, data indicating a selection to grant the visitor access to the property, and based on receiving data indicating the selection to grant the visitor access to the property, disarm the monitoring system and unlock an entry way to the property.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for controlling access to an unattended monitored property by vendors. For example, when users associated with the monitored property are away, the monitoring system may allow access to the property for a package delivery. The monitoring system may be configured to authenticate the vendor's identity, the vendor's location, and the homeowner's service request using different authentication techniques, and allow the vendor to enter the monitored property to complete the service request. The monitoring system may then monitor the vendor at the property, and rearm the monitoring system when the vendor leaves the property. For example, the monitoring server may monitor a maid while she cleans the monitored property, and rearm the monitoring system when the maid leaves the property. In some implementations, the monitoring system may be a stand-alone home automation system (e.g., a smart home). In this instance, instead of rearming the monitoring system, the automation system may re-secure the property (e.g., lock the door) when the maid leaves the property.

Figure 1:
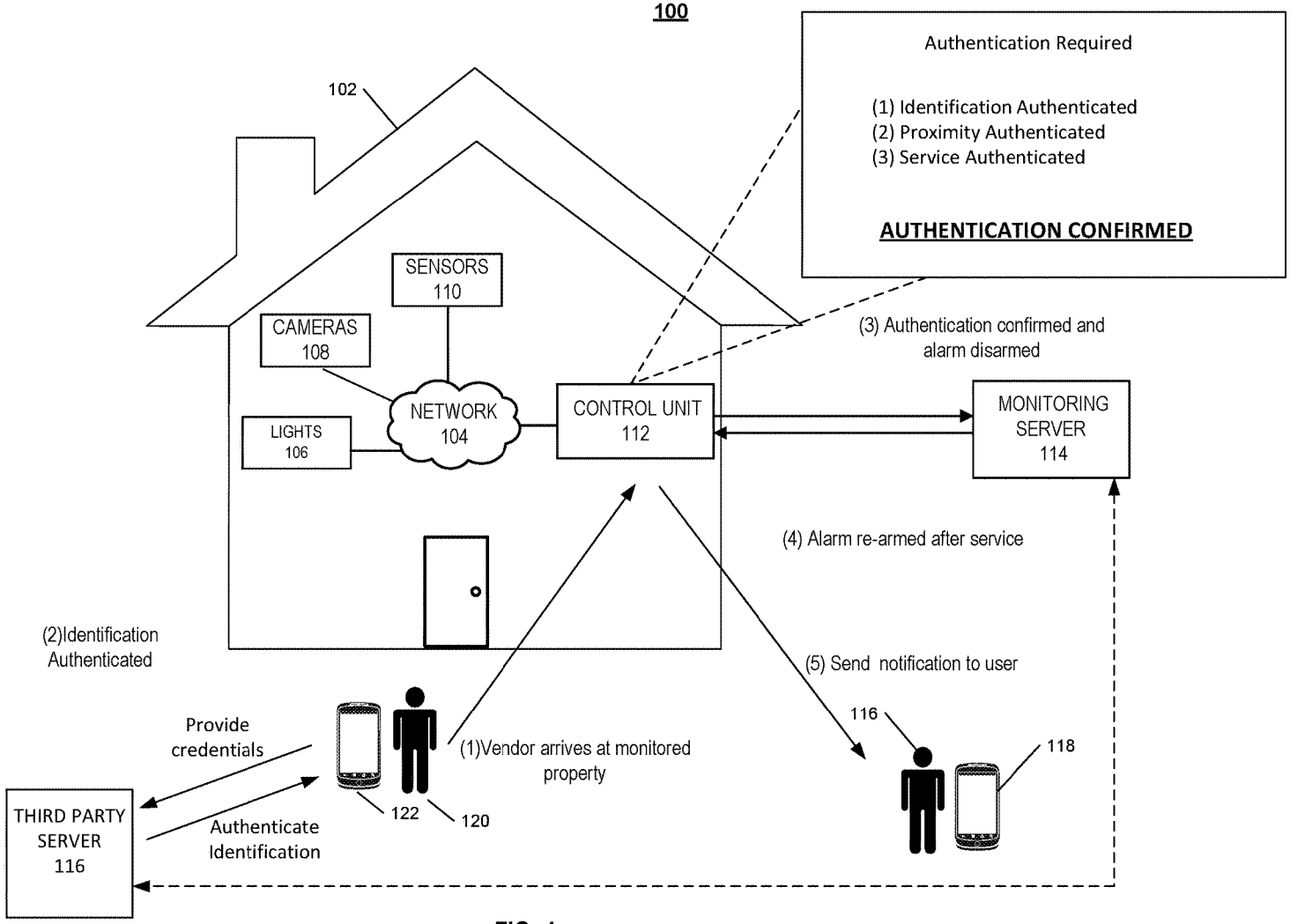
FIG. 1 illustrates an example of a system for controlling access to an unattended monitored property.

FIG. 1 illustrates an example of controlling access to the monitored property. As shown in FIG. 1, a property 102 (e.g., a home) of a user 116 is monitored by an in-home monitoring system (e.g., in-home security system) that includes components that are fixed within the property 102. The in-home monitoring system may include a control panel 112, one or more lights 106, one or more cameras 108, one or more sensors 110, and access control devices for entry points such as doors, garage doors, pet doors, etc. The one or more cameras 108 may include video cameras that are located at the exterior of the property near to the front door, and the one or more sensors 110 may include a motion sensor located at the exterior of the property. The one or more sensors 110 may include a front door sensor that is a contact sensor positioned at a front door of the property 102 and configured to sense whether the front door is in an open position or a closed position.

The control panel 112 communicates over a short-range wired or wireless connection with each of the one or more lights 106, one or more cameras 108, and one or more sensors 110 to receive sensor data descriptive of events detected by the one or more lights 106, one or more cameras 108, and one or more sensors 110. The control panel 112 also communicates over a long-range wired or wireless connection with a monitoring server 114. The monitoring server 114 is located remote from the property 102, and manages the in-home monitoring system at the property 102, as well as other (and, perhaps, many more) in-home monitoring systems located at different properties that are owned by different users. In some implementations, the monitoring server 114 may be located locally at the monitored property 102. The monitoring server 114 receives, from the control panel 112, sensor data descriptive of events detected by the sensors included in the in-home monitoring system of the property 102.

In the example shown in FIG. 1, a vendor 120 arrives at the monitored property 102. A vendor 120 may be a delivery man, a dog walker, a cable technician, a maid, a gardener, a plumber, a drone (e.g., a delivery drone) or any other suitable service provider. The monitored property 102 is configured to allow access to the monitored property 120 only by authenticated vendors. A user 116 associated with the monitored property 120 may enroll their property in to a smart access service, and may identify, from a list of vendors registered with the smart access service, one or more vendors that are authorized to enter their property while the user is away. In some implementations, the smart access service is a feature of a native application for the monitoring system at the monitored property 120. In these implementations, the user 116 may access the native application from his mobile device 118, and may enroll in the smart access service. The user may identify one or more vendors, and may schedule services, provide timing schedules for each vendor, provide vendor ratings, and log service requests through the application. In these implementations, the smart access service is managed by the monitoring server 114 that manages the in-home monitoring system at one or more properties. In other implementations, a third party server 116 may manage the smart access service, and one or more servers of one or more vendors may communicate with the third party server to enroll in the access service. In these implementations, the monitoring server 114 may be in communication with the third party server 116.

The service request is authenticated when the vendor 120 arrives at the monitored property 102 during the scheduled time for a request. The user may schedule the service through the native application on the user's device 118, and the service may be authenticated by the monitoring server 114. For example, the user may schedule a dog walk for 1:00 PM on Wednesday through the native application, the dog walker may arrive at the monitored property at 12:59 PM, and the monitoring server 114 may authenticate the service based on the vendor 120 arriving close to the scheduled service time. The monitoring server 114 may communicate the service authentication to the control unit 112. In some examples, where the service involves a physical object, for example a package delivery, the vendor 120 may scan a QR code or barcode on the package with his mobile device 122. The vendor 120 may access the native application on his mobile device 122, and may scan the QR code or the barcode on the package. The monitoring server 114 at the backend of the native application may compare the scanned QR code or barcode against a list of one or more codes associated with packages. When there is a match between the scanned QR code or barcode and the code listed for the package to be delivered to the monitored property 102, the monitoring server 114 authenticates the service. The service authentication is then communicated to the control unit 112. In some implementations, the vendor 120 may access a package delivery application that is managed by the third party server 116. In these implementations, the third party sever 116 compares the scanned QR code or barcode against a list of one or more codes associated with packages. When there is a match between the scanned QR code or barcode and the code listed for the package to be delivered to the monitored property 102, the third party server 116 authenticates the service, and communicates the authentication to the monitoring server 114.

In some examples, the monitored property 102 may be equipped with a sensor on the exterior of the property that may be configured to scan the QR code or barcode on the package. When the package is scanned by the sensor, the sensor communicates the scanned data to the control unit 112. The control unit 112 then communicates the data to the monitoring server 114. The monitoring server 114 may compare the scanned QR code or barcode against a list of one or more codes associated with packages and authenticate the service once there is a match. In another example, the vendor 120 may scan the package with a company issued device, when the package is scanned, the company backend server may compare the scanned QR code or barcode and once a match is confirmed, the backend server communicates an authentication to the monitoring server 114.

In some implementations, the monitored property 102 may be equipped with a wireless sensor on the exterior of the property. The sensor may be configured to wirelessly scan for beacons or receive data from beacons included with packages or other services providers. For example, a package may include a Bluetooth low energy beacon that periodically transmits data. Similar to the previous QR example, the sensor may then communicate data related to the beacon to the monitoring server 114.

The vendor's identity may be authenticated by one or more different ways. For the example illustrated in FIG. 1, the vendor 120 may provide log in credentials through the application on the vendor's mobile device 122. As illustrated, the vendor provided credentials may be authenticated by the third party server 116. The third party server 116 may then communicate the authentication to the monitoring server 114. In some implementations, the vendor's log in credentials may be authenticated by the monitoring server 114. The vendor's identity may be authenticated when the vendor 120 uses a company issued device to scan a QR code or barcode on a package. In some examples, the vendor 120 may scan a company issued credential at the monitored property 120. In these examples, the monitored property 120 may have a scanning sensor located at the exterior of the property, and the vendor 120 may scan a physical identification card or badge to authenticate the vendor's identity. The company issued credential may be an electronic credential that the vendor 120 could display on his mobile device 122. The vendor's identification may be authenticated when the vendor scans his mobile device. In some implementations, the vendor 120 may provide biometric data to an electronic sensor at the monitored property 102 to authenticate the vendor's identity. For example, the user may approach the monitored property 102 and have his retina scanned by a retina scanner sensor at the front door of the property. The vendor 120 may provide finger prints, and or any other suitable form of biometric data to a sensor at the property to authenticate the vendor's identity.

The control unit 112 then authenticates the vendor's proximity to an entry point of the monitored property 102 before allowing the vendor access to the property. The vendor's proximity may be authenticated by one or more different techniques. For example, the vendor's location may be determined based on the GPS location of the vendor's mobile device 122. Cellular triangulation may be used to determine the location of the vendor's mobile device, and when the vendor is within a particular threshold distance from the property 102, the monitoring server 114 communicates a proximity authentication to the control unit 112. In some implementations, the third party server 116 may determine the location of the vendor's mobile device 122, and may communicate the vendor's location to the monitoring server 114 for authentication. In some examples, Wi-Fi proximity is used to determine the vendor's location. When the vendor's mobile device 122 is outside the monitored property 102 Wi-Fi range, the vendor's proximity is not authenticated. In the examples where the vendor's identification is authenticated by a local sensor at the monitored property 102, the vendor's proximity is simultaneously authenticated. For example, when the vendor 120 provides an identification badge to be scanned by a sensor at the property, the vendor's location is authenticated.

When the control unit 112 verifies the three factors, the control unit 112 grants the vendor 120 access to the monitored property 102. For the example illustrated in FIG. 1, where the monitored property 102 is equipped with an alarm system, the control unit 112 disarms the alarm system, and automatically unlocks an entry point at the property. The entry points such as the front door and or the garage door of the monitored property 102 may be equipped with automatic locks, and contact sensors that sense whether the door is open or closed. In some examples, the entry point may be equipped with a keypad, and a PIN code may be entered to unlock the door. In these examples, the monitoring server 114 may communicate a temporary PIN code that may be used by the vendor 120 to access the door of the property. The alarm may be disarmed for a specific amount of time based on the service. For example, the alarm may be disarmed for five minutes to allow a delivery man to drop a package, and may be disarmed for an hour when a plumber comes to fix a leaking pipe.

The one or more cameras 108 and one or more sensors 110 throughout the monitored property 102 may be configured to monitor the activity of the vendor 120 to ensure the safety of the property during the service. The one or more cameras 108 throughout the property may be configured to start capturing images and video when the alarm system is temporarily disarmed. A speaker on the control panel 112 of the alarm system may generate an audible alert to the vendor 120 if the cameras or sensors indicate that the vendor 120 moved to an unexpected area of the property. For example, the speaker may prompt a plumber to leave the living room area if one or more cameras detect the plumber in the living area when the service request specifies that the plumber is to fix a leaking pipe located in the kitchen area. An alarm may be generated when a vendor does not move away from the unexpected area of the property. In some implementations, the interior doors to restricted areas of the monitored property 102 may automatically lock when the alarm system is disarmed for a vendor. For example, the door to the bedrooms may be locked when a cable technician visits to install equipment in the living room. The monitored property 102 may be equipped with drones that may monitor and track the vendor 102 throughout the property.

The alarm system at the monitored property 102 is rearmed when the vendor 120 completes the service and vacates the property. The alarm system may be configured to automatically rearm when the time allotted for the completion of the service has elapsed. For example, the alarm system may rearm after the allotted five minutes for a package delivery. Each of the one or more entry points at the monitored property 102 must be closed for the alarm system to successfully arm. The entry points may be equipped with contact sensors that communicate to the control unit 112 when the entry point is opened or closed. In some implementations, the alarm system may rearm when the vendor 120 closes the entry point and enters an exit code. In these implementations, the exit code may be communicated to the mobile device 122 of the vendor 120 when the vendor 120 is authenticated to enter the monitored property. When the vendor 120 enters the exit code, and the entry point is confirmed to be in a closed position, the control unit 112 rearms the alarm system. In some implementations, the alarm is rearmed when the vendor's location confirms that the vendor 120 is outside of a threshold distance from the monitored property 102. In the implementations where the vendor 120 provides biometric data to a sensor at the monitored property 102 to gain access, the vendor 120 may provide a second scan to indicate that the service is complete. When the second scan is received, the control unit 112 can rearm the alarm system. For example, when a vendor 120 provides a finger print scan to an external sensor at the property for access, the vendor 120 may provide finger print to indicate the service is complete and the alarm system can be rearmed. The alarm system may rearm when the control unit 112 receives a visual confirmation from an external camera that the vendor 120 has vacated the monitored property 102 and closed the entry way.

The control unit 112 may generate an alert to the monitoring server 114 when the control unit 112 cannot rearm the alarm system due to an open entry point. The monitoring server 114 may communicate a notification to the mobile device 122 of the vendor 102 reminding the vendor to close all entry ways for the system to rearm. The monitoring server 114 may also send a notification to the mobile device 118 of the user 116 associated with the monitored property 102. The control unit 112 may send notification to the mobile device 118 of the user 116 to notify of the completion of the service request. The notification may include the time of entry and the time of exit for the vendor 120. The user 116 may receive the notification as an in-app message. In some implementations, the user 116 may be able to view the video recorded during the service request through the application interface to confirm the vendor completed.

In some implementations, the mobile device 122 communicates directly with the monitoring server 114. In this instance, the mobile device 122 includes a specific application that allows the mobile device 122 to communicate with the monitoring server 122. By communicating with the monitoring server 114, the mobile device 122 may not need to communicate with the third party server 116 to authenticate the mobile device 122 to the monitoring server 114. Instead, the monitoring server 114 authenticates the mobile device 122 directly.

As briefly noted above, the functionality of FIG. 1 may apply to a property 102 that is not connected with the monitoring server 114. For example, the property 102 may be a smart property that has home automation features such as automated locks, lights, cameras, and sensors but not connected to a monitoring server 114. The smart property may be self-monitored in that is alerts a user to activity in the house but does not alert the monitoring server 114. The smart property may also be able to authenticate and verify vendors using information supplied by the owner, resident, or other authorized user of the property or communicate with the third party server 116 to authenticate a vendor. In this instance, the smart property may provide functionality similar to that of FIG. 1 without connecting to the monitoring server 114. Used throughout this document, the functionality related to rearming a monitoring system may instead describe the functionality related to re-securing a door by a home automation system of a property. In some implementations, the control unit 112 may authenticate a vendor without communicating with the monitoring server 114 in a property 102 without home automation features.

In some implementations, the functionality of FIG. 1 is not restricted to instances when property 102 in unattended. For example, the residents of the property 102 may be having a party in the backyard. Some residents may also be inside the house. The residents in the backyard may request a pizza delivery. The pizza requesting residents could use the functionality of FIG. 1 to allow the pizza deliverer to enter the property 102 and delivery the pizza without interrupting the party or the other residents inside the house.

In some implementations, the functionality of FIG. 1 is not restricted to instances when the vendor 120 is an actual person. For example, the vendor 120 may be a drone, or other type of robot, delivering a package or providing a service. The drone may scan the package when the drone is at the property. The control unit 112 may disarm the monitoring system and unlock the door to allow the drone to enter. The drone places the package in the property 102 and leaves the property. The control unit 112 locks the door or rearms the system or both.

Figure 2:
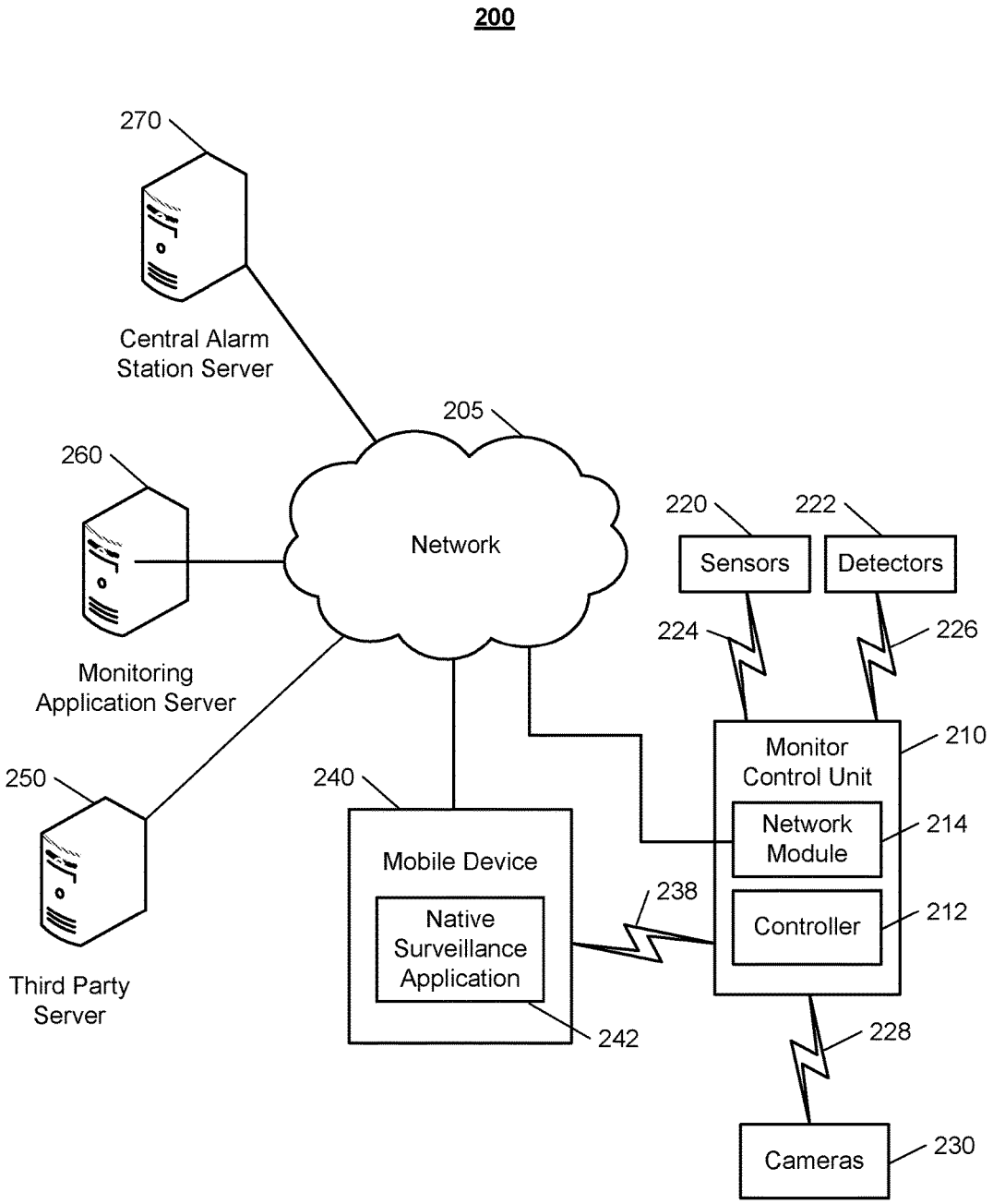
FIG. 2 illustrates an example of a monitoring system.

FIG. 2 illustrates an example of a system 200 configured to monitor a property. The system 200 includes a network 205, a monitoring system control unit 210, one or more user devices 240, a monitoring application server 260, a third party server 250, and a central alarm station server 270. The network 205 facilitates communications between the monitoring system control unit 210, the one or more user devices 240, the monitoring application server 260, and the central alarm station server 270. The network 205 is configured to enable exchange of electronic communications between devices connected to the network 205. For example, the network 205 may be configured to enable exchange of electronic communications between the monitoring system control unit 210, the one or more user devices 240, the monitoring application server 260, and the central alarm station server 270. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag.

The one or more cameras 230 may be a video/photographic camera or other type of optical sensing device configured to capture images. For instance, the one or more cameras 230 may be configured to capture images of an area within a building monitored by the monitor control unit 210. The one or more cameras 230 may be configured to capture single, static images of the area and also video images of the area in which multiple images of the area are captured at a relatively high frequency (e.g., thirty images per second). The one or more cameras 230 may be controlled based on commands received from the monitor control unit 210.

The one or more cameras 230 may be triggered by several different types of techniques. For instance, a Passive Infra Red (PIR) motion sensor may be built into the one or more cameras 230 and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220.

The sensors 220, the detectors 222, and the cameras 230 communicate with the controller 212 over communication links 224, 226, and 228. The communication links 224, 226, and 228 may be a wired or wireless data pathway configured to transmit signals from the sensors 220, the detectors 222, and the cameras 230 to the controller 212. The communication link 224, 226, and 228 228 may include a local network, such as, 802.11 "Wi-Fi" wireless Ethernet (e.g., using low-power Wi-Fi chipsets), Z-Wave, Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240.

The user device 240 is a device that hosts and displays user interfaces. The user device 240 may be a cellular phone or a non-cellular locally networked device with a display. The user device 240 may include a cell phone, a smart phone, a tablet PC, a personal digital assistant ("PDA"), DIAD (Delivery Information Acquisition Device), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a native surveillance application 242. The native surveillance application 242 refers to a software/firmware program running on the corresponding mobile device that enables the user interface and features described throughout. The user device 240 may load or install the native surveillance application 242 based on data received over a network or data received from local media. The native surveillance application 242 runs on mobile devices platforms, such as iPhone, iPod touch, Blackberry, Google Android, Windows Mobile, etc. The native surveillance application 242 enables the user device 240 to receive any data from the monitoring system. In some implementations, the user device 240 does not need a native surveillance application 242 or other specific application to communicate with the servers 250, 260, 270, or the monitor control unit 210 for initiating access to a monitored property. For example, a package delivery person may scan a package with a DIAD. The DIAD sends the package information to the delivery company servers. The delivery company servers communicate with the servers 250, 260, 270, or the monitor control unit 210 using, for example, one or more APIs.

In some implementations, the user device 240 communicates with and receives monitoring system data from the monitor control unit 210 using the communication link 238. For instance, the user device 240 may communicate with the monitor control unit 210 using various local wireless protocols such as Wi-Fi, Bluetooth, Z-Wave, Zigbee, "HomePlug," or other Powerline networks that operate over AC wiring, or Power over Ethernet (POE), or wired protocols such as Ethernet and USB, to connect the user device 240 to local security and automation equipment. The user device 240 may connect locally to the monitoring system and its sensors and other devices. The local connection may improve the speed of status and control communications because communicating through the network 205 with a remote server (e.g., the monitoring application server 260) may be significantly slower.

The third party server 250 is an electronic device that is configured to exchange electronic communications with the monitoring application server 260 and the other devices within the network configuration. The third party server 250 may be a platform used by one or more vendors to enroll in a smart access service. The third party server 250 may be in communication with the servers of the one or more vendors through one or more APIs.

Figure 3:
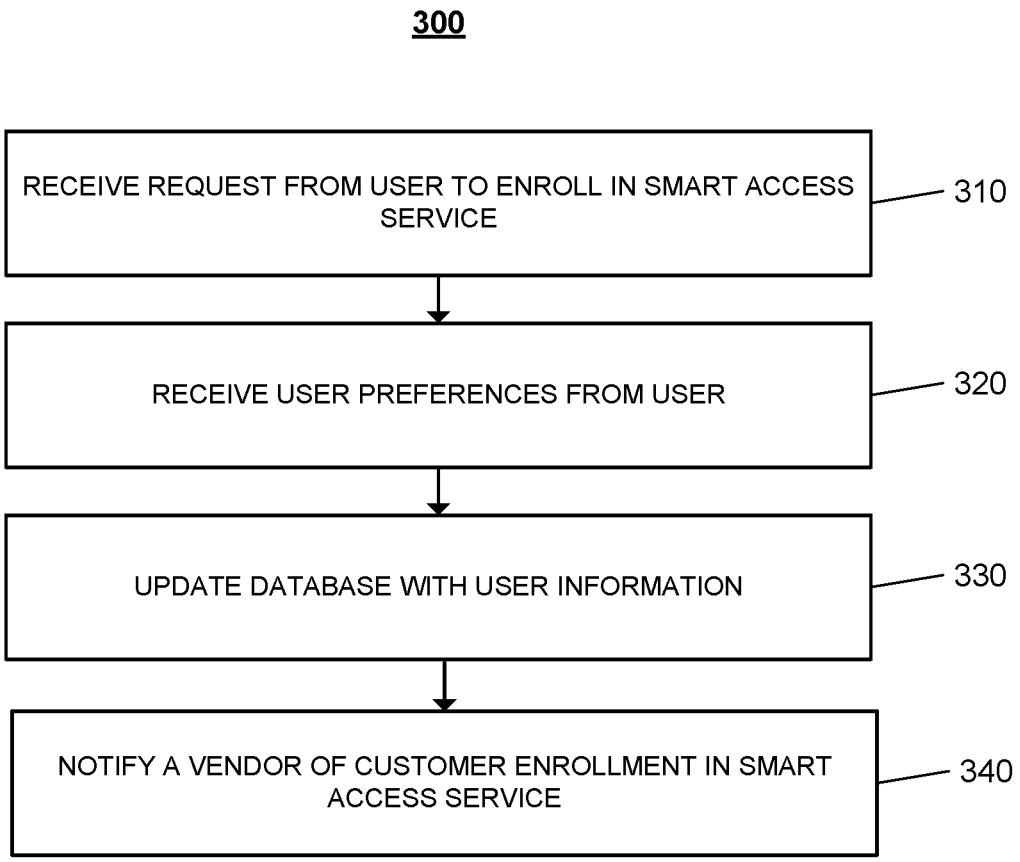
FIG. 3 illustrates an example process for notifying a vendor of customer enrollment.

FIG. 3 illustrates an example process 300 for notifying a vendor of a customer enrollment. A server receives a request from a user to enroll in a smart access service (310). In some implementations, server is a third party server, and in other implementations, the server is the monitoring server. The user may be an owner of a monitored party, renter of the monitored property, or any other party responsible for the monitored property that wishes to enroll the monitored property in a smart access service. The smart access service allows a user to receive services from authorized vendors at the monitored property without being present at the property during the time of service. For example, the smart access service may allow for a cable technician to enter the monitored property to install cable services while the user is away. A user may use a native application on a user device to request enrollment to the smart access service.

In the implementations where the server is the monitoring server, the user may utilize the native application to configure settings associated with the monitoring system at the property. For example, the user may arm and disarm an alarm system at the monitored property through the native application on the user device. In other implementations, the server may be a third party server that is in communication through application programming interfaces (APIs) with the monitoring server. In these implementations, the smart access service may be configured by a user through a third party application that is in communication with the monitoring system native application.

The server receives user preferences from the user (320). The request to enroll in the smart access service may include one or more user set preferences. The user may identify the one or more vendors that the user would like to receive smart access service from. For example, the user may identify FedEx, Comcast, and Angie's dog walking as the services of preference. The user may also identify a timing schedule for receiving smart access services from each of the one or more vendors. For example, the user may set a schedule to receive packages from FedEx between 9 AM and 5 PM on a Monday to Friday, and to receive dog walking service between 1 PM to 3 PM on a Monday, Wednesday, and Friday.

The server updates a database with the user information (330). The database may be a database associated with the server, and the database may be updated based on the newly enrolled users and their associated user information. The user information may include a profile for the user. The information may include an identifier for the monitored property associated with the user, the user's address, the user's name, and the user's identified preferences. The database may store a list of each of the one or more monitored properties enrolled in the smart service access, the user preferences for each user, and other user information associated with users from each enrolled property.

The server notifies the one or more vendors of a user's enrollment (340). A vendor is notified by API integration when an enrolled user identifies the vendor in the user preferences. The vendor may also receive a notification when an enrolled user removes a vendor from their preferences. Once a user is enrolled in the smart service access, the user may access the application to further configure user preferences. For example, the user may alter timing schedules and may add or remove approved vendors. In some implementations, the application may allow the user to provide delivery instructions, provide vendor ratings, and make service requests.

Figure 4:
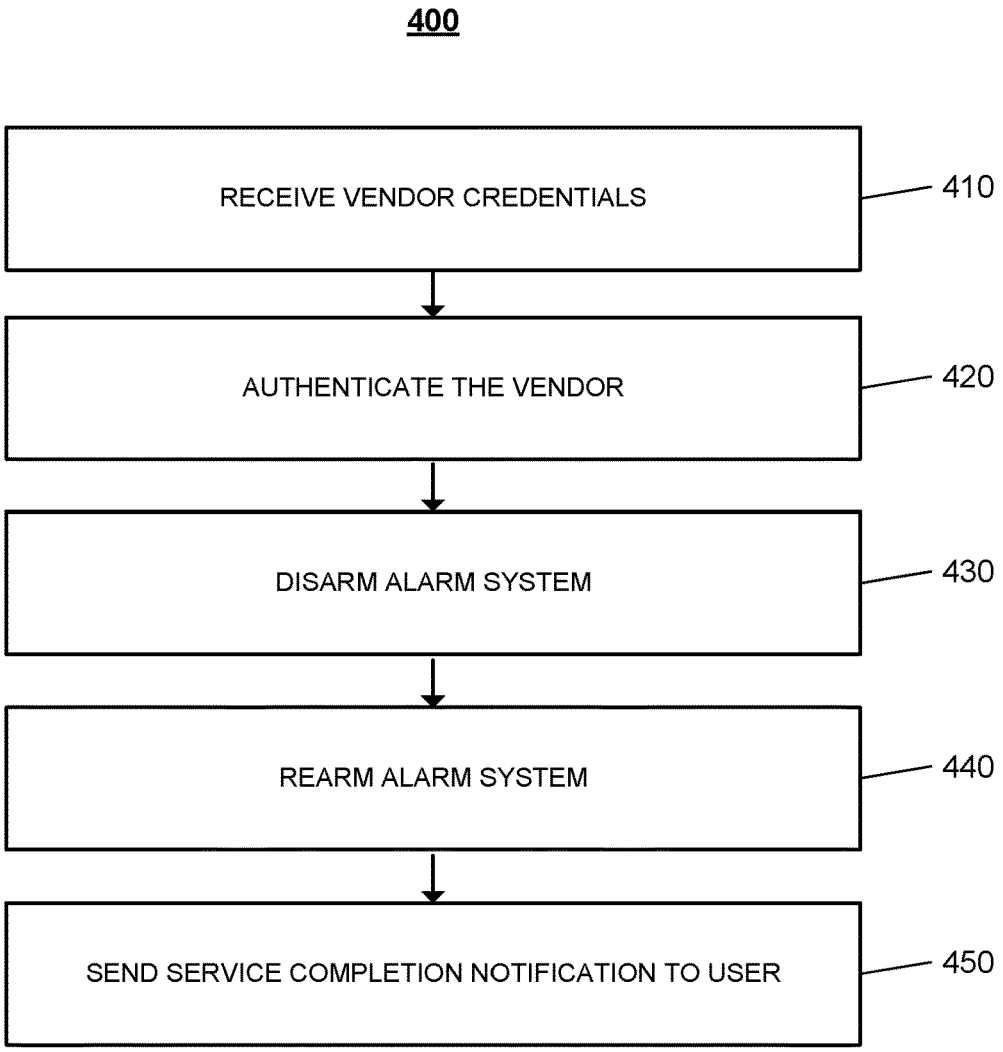
FIG. 4 illustrates an example process for sending a confirmation notification to a user.

FIG. 4 illustrates an example process 400 for sending a service completion notification to a user. The server receives vendor credentials (410). The server may be a monitoring server that manages the control units of one or more monitored properties. The vendor may provide their credentials by successfully logging into a secured mobile application that is tied to the vendor company. The server may receive the vendor credentials through API integration with the vendor mobile application. In some examples, the vendor credentials may be a user name and password. In other examples, the vendor credentials may be a PIN code.

The server authenticates the vendor (420). The server requires a three factor authentication process before instructing the monitoring system at the property to allow a vendor to access the property. The server authenticates the service request, authenticates the identification of the vendor, and authenticates the location of the vendor. In some implementations, each of the three authentication steps are carried out simultaneously.

The service request is authenticated by one or more different authentication methods based on the type of service. In some examples, where the service request involves a vendor entering a property without a visible service item, for example a gardener or plumber service request, the vendor may use the application on their mobile device to request authentication. The backend server may authenticate the request based on the scheduled services associated with the monitored property. For example, the user at the monitored property may schedule a dog walking appointment for 2 PM on a Tuesday, and the dog walker may be requesting service authorization at 2:03 PM through their mobile device. Based on the match between the scheduled request and the authorization of the service request, the service request may be authenticated. In the examples where the service involves a tangible object, such as a package delivery, or grocery drop off, the authentication may involve scanning the object. For example, the vendor may have a company issued device that can be used to scan the object, such as a DIAD V device. In some examples, the vendor may scan a barcode or QR code on the package with their mobile device.

The vendor identification is verified when the user successfully logs into the secured mobile application tied to the vendor company. In some implementations, the server may receive a vendor identification notification through API integration with a server maintained by the vendor. In other implementations, the server may receive the vendor credentials and authenticate the vendor identification.

Based on the authentication of the vendor identification, the server then authenticates the vendor location. To ensure the safety of the monitored property, the alarm system is not disarmed unless the vendor is near to a point of entry at the property. The vendor's location may be authenticated based on the GPS location of the vendor's mobile device. For example, the cell triangulation may be used to determine the vendor location. In some examples, the location of the vendors may be determined using Wi-Fi proximity techniques, Bluetooth low energy (BLE) beacons, or any other suitable technique for determining location of a device associated with the vendor.

In some implementations, the electronic sensors at the monitored property may authenticate the identity and the location of the vendor simultaneously. For example, a doorbell camera at the monitored property may be configured to scan a QR code presented by the vendor to authenticate the vendor's identity and location. The QR code may be generated by the application on the vendor's mobile device, and the vendor may place the QR code in front the camera to verify the displayed code. In some implementations, the vendor may provide biometric information to authenticate identity and location. In these implementations, the doorbell may be equipped with a finger print scanner or a retina scanner that allows the vendor to approach the property and provide biometric information. Once the biometric information is authenticated the location of the user is simultaneously authenticated.

Based on the authentication of the service request, the vendor identity, and the vendor location, the alarm system at the monitored property is disarmed (430). Once the server authenticates the vendor, the server communicates the authentication to the control unit at the monitored property. The vendor is given temporary access to the monitored property to perform the requested service. The control unit may communicate with the lock on the front door of the property to automatically unlock the door for the vendor to access. In some implementations, when the vendor is authenticated, the server communicates a PIN code to the vendor's device. The vendor may enter the PIN code to unlock a front door, or garage door at the monitored property allowing the vendor to enter the monitored property. The duration of the vendor's allowed access to the property is based on the type of service requested. For example, a delivery man dropping off a package may be allowed five minutes before the alarm system sounds.

The one or more cameras and one or more sensors monitor the activity of the vendor to ensure the safety of the property during the service. The one or more cameras throughout the property may be configured to start capturing images and video when the alarm system is temporarily disarmed. In some implementations, the interior doors to restricted areas of the monitored property may automatically lock when the alarm system is disarmed for a vendor. The monitored property may be equipped with drones that may monitor and track the vendor throughout the property.

The alarm system at the monitored property is rearmed (440). The alarm system may be configured to automatically rearm when the time allotted for the completion of the service has elapsed. The entry points may be equipped with contact sensors that communicate to the control unit when the entry point is opened or closed. In some implementations, the alarm system may rearm when the vendor closes the entry point and enters an exit code. In these implementations, the exit code may be communicated to the mobile device of the vendor when the vendor is authenticated to enter the monitored property. When the user enters the exit code, and the entry point is confirmed to be in a closed position, the control unit rearms the alarm system. In some implementations, the alarm is rearmed when the vendor's location confirms that the vendor is outside of a threshold distance from the monitored property.

The control unit sends a service completion notification to the user (450). The notification may include the time of entry and the time of exit for the vendor. The user may receive the notification as an in-app message.

Figure 5:
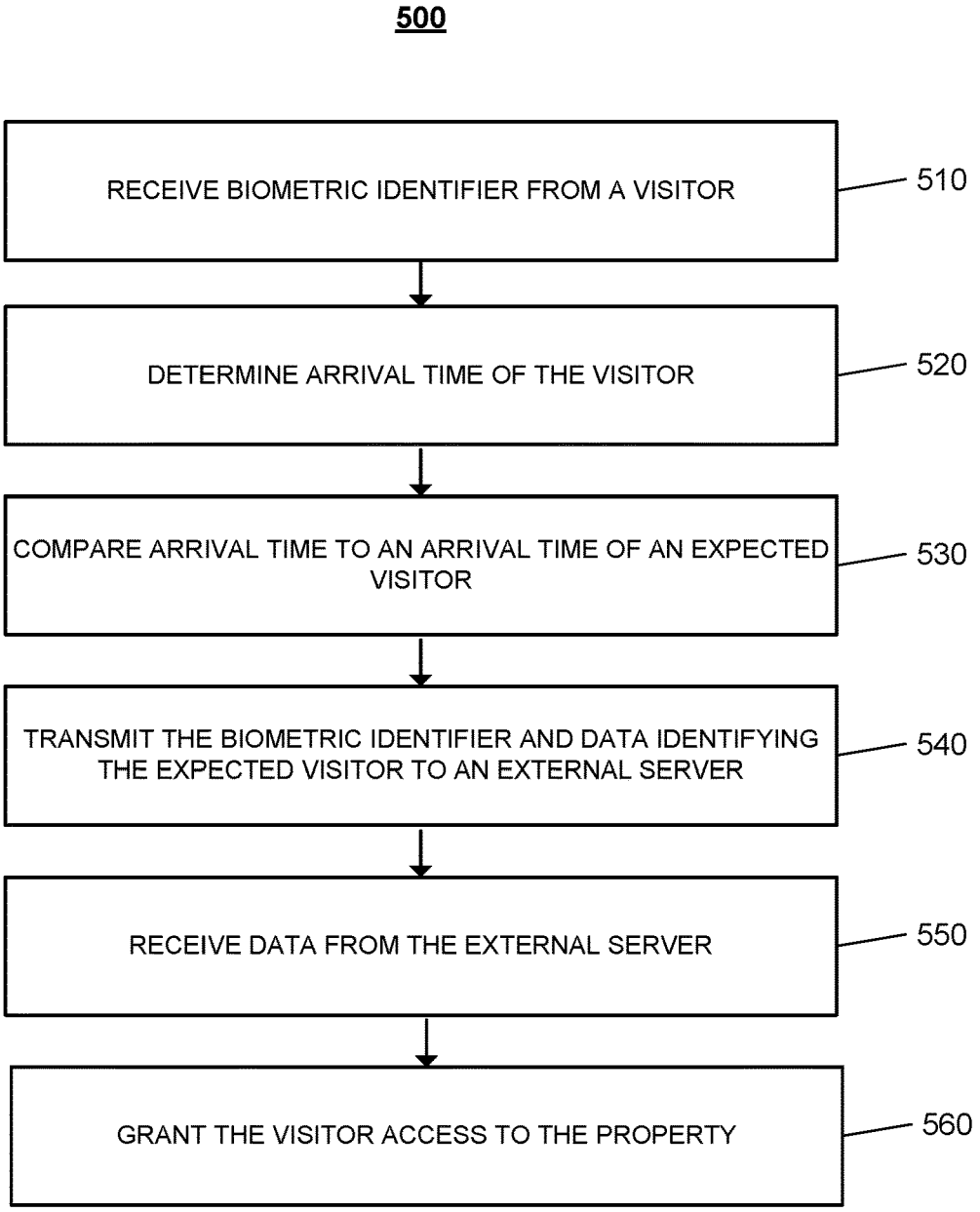
FIG. 5 is a flow chart of an example process for granting a visitor access to the monitored property.

FIG. 5 is a flow chart of an example process for granting a visitor access to a monitored property. The monitor control unit receives a biometric identifier from a visitor to the property (510). A visitor may be a service provider such as a maid, a dog walker, a plumber, an electrician, a drone (e.g., a delivery drone) or any other suitable service provider. The property 102 may be monitored by a monitoring system that is managed by the control unit 112. When a visitor arrives at the property 102, the control unit 112 authenticates the identification of the visitor, the proximity of the visitor, and the service appointment before allowing the visitor access to the property.

The control unit is configured to grant access to the monitored property when each of the three factors are authenticated. A resident of the monitored property may enroll the property 102 into a smart access service that allows the resident to schedule services at the property at times when the property is unattended. The resident may identify one or more service providers that are authorized to access the property 102 during a scheduled service appointment. The resident may access the smart access service through a native monitoring system application on the resident's user device to enroll into the smart access service, and to schedule service appointments. In some implementations, the smart access service is managed by a monitoring server 114. In other implementations, the smart access service is managed by a third party server that is in communication with the monitoring server 114 and the control unit 112.

The biometric identifier may be received from one or more sensors located at the property. The monitored property may be equipped with one or more sensors that are each configured to receive biometric data from the visitor. The monitored property may include a doorbell that includes a fingerprint reader that is configured to scan the finger of a visitor when the visitor arrives at the property. In some examples, the monitored property may be equipped with a retina scanner sensor that is configured to capture a retina scan of the visitor when the visitor arrives at the property. In other examples, a camera may capture one or more images of the visitor, or capture video data of the visitor as the visitor approaches the property. In these examples, facial recognition may be used to authenticate the identity of the visitor at the property. For example, the monitored property may be equipped with a doorbell camera or an external camera that captures image and video data of the visitor as the visitor approaches the property. The visitor may provide any other suitable form of biometric data to a sensor at the monitored property 102.

In some implementations, where the scheduled service involves a physical object, the control unit may receive data when the object is scanned by a sensor at the property. For example, when the scheduled service is a package delivery, the visitor may scan a QR code or barcode on the package by an electronic reader sensor at the monitored property. The control unit may compare the received code data to one or more codes associated with one or more packages. The control unit authenticates the delivery service when the received QR code or barcode data matches the data associated with the package delivery scheduled at the monitored property. In some implementations, the control unit may communicate the received code data to the monitoring server, which in turn compares the received code data to one or more codes associated with one or more packages. In these implementations, the monitoring server may authenticate the delivery service when the received QR code or barcode data matches the data associated with the package delivery scheduled at the monitored property. The monitoring server then communicates the authentication data to the control unit.

In some implementations, a video camera located at the monitored property may scan the barcode on a package as a delivery person approaches the monitored property. In other implementations, the delivery person may scan the QR code or barcode on the package using their mobile device. In another implementation, the visitor may scan the package with a company issued device. When the package is scanned, the backend server of the company may compare the scanned code, and when a match is confirmed, the backend server communicates an authentication to the control unit. In some examples, the backend server communicates the authentication to the monitoring server, which in turn communicates with the control unit.

In some implementations, the monitored property may include a wireless sensor located at an exterior of the property. The wireless sensor may be configured to wirelessly scan for beacons or receive data from beacons included with packages or other services providers. For example, a package may include a Bluetooth low energy beacon that periodically transmits data. The sensor may then communicate data related to the beacon to the monitoring server. In some implementations, a service provider that is assigned to a service appointment at the property is assigned a beacon to carry on their person. When the service provider carrying the beacon arrives at the property, the wireless sensor at the property may communicate with the beacon. The control unit at the monitored property may confirm the package delivery based on the wireless sensor at the property successfully communicating with the beacon assigned to the service provider.

The control unit determines an arrival time of the visitor based on receiving the biometric identifier (520). When the control unit at the property 102 receives biometric data from at least one of the one or more sensors located at the monitored property, the control unit logs the current time as the arrival time of the visitor. For example, when the visitor scans their retina at a retina-scanning sensor, the control unit logs the arrival time as the time the retina data is received.

The control unit compares the arrival time of the visitor to an expected arrival time of an expected visitor (530). The control unit may have stored in its memory the time for a scheduled service request at the property. For example, when the resident schedules an appointment with an electrician for 10:00 AM, the control unit stores the expected arrival time as 10:00 AM. In some examples, the expected time of arrival for a 10:00 AM appointment may range from 9:45 AM to 10:15 AM. The control unit authenticates the service when the visitor arrives at the monitored property during the expected arrival time.

The control unit transmits the biometric identifier and data identifying the expected visitor to a third-party server (540). The control unit transmits the biometric data received by the control unit to a third party server that manages the smart access service. In some implementations, the control unit transmits the biometric data to the monitoring server, which in turn transmits the data to the third party server, and in other implementations, the control unit transmits the biometric identifier directly to the third party server. In these implementations, the third-party server authenticates the identity of the visitor at the property. In other implementations, the control unit transmits the biometric data to the monitoring server, and the monitoring server authenticates the identity of the visitor.

The third-party server authenticates the identity of the visitor based on the received biometric identifier. The third party server may store the biometric data associated with the one or more service providers registered with the smart access service. The one or more service providers may be employees of one or more service providing companies. For example, the one or more service providers may be employees of Overnight Delivery Company, Joe's Plumbing, Cable Company, or any other company registered with the smart access service. When the third party server receives a biometric identifier from a visitor to the property, the received biometric identifier is compared to the stored biometric data of an expected visitor. The expected visitor may be a specific service provider that has been assigned to a scheduled service appointment. The third party authenticates the identity of the visitor based on the biometric data matching the biometric data of the expected visitor.

In some implementations, a service provider other than the expected visitor may be dispatched to the monitored property. This may occur if the assigned service provider has called in sick, or is no longer employed with the company. In these implementations, the company may assign another employee to provide the service at the property. When the service provider arrives at the monitored property and provides his/her biometric data, the third party server may determine that the received biometric data does not match the biometric data of the expected visitor. The third party server may then compare the received biometric data to the biometric data of the one or more other employees of the company. When the third party server determines the received biometric data matches the biometric data of another employee of the company, the identity of the visitor at the monitored property is authenticated.

In some implementations, the third party server may use one or more different facial recognition techniques to authenticate the identity of the visitor. The third party server may receive the video data captured by the one or more cameras at the monitored property, and may analyze the captured data to determine the identity of the visitor. The captured video data may also be analyzed using one or more algorithms to analysis the height, weight, and gait of the visitor approaching the property. The third party server may authenticate the identity of the visitor at the monitored property based on the height weight, and/or gait of the visitor matching the height, weight, and or gait of the expected visitor.

The third party server may analyze the captured video data for specific objects. The server may analyze the captured video data to identify a vehicle associated with an assigned service provider. For example, the server may analyze the captured video data to identify a delivery truck, a license plate associated with an expected delivery vehicle, a logo for the service provider's company, a delivery uniform, or any other suitable object that is specific to the assigned service provider.

The third party server verifies that the assigned service provider is located in close proximity to the monitored property. In some implementations, the location of the assigned service provider's mobile device is used to determine the location of the service provider. In some implementations, Wi-Fi proximity is used to determine the service provider's location. When the service provider's mobile device is outside the monitored property Wi-Fi range, the vendor's proximity is not authenticated.

The control unit receives data indicating the biometric identifier corresponds to the expected visitor and data indicating that an electronic device of the expected visitor is located at the property (550). When the third party server authenticates the identity of the visitor, and confirms the visitor is within close proximity of the monitored property, the third party server communicates the data to the control unit.

The control unit grants the visitor access to the property based on the data indicating that the biometric corresponds to the expected visitor, and the data indicating that the electronic device of the expected visitor is located at the property (560). The control unit may disarm the monitoring system at the property 102 and unlock an entryway to the property to allow the visitor access.

In some implementations, the one or more cameras and one or more sensors located throughout the monitored property are used to monitor the service provider as he/she completes the service at the property. The resident of the property may identify one or more rooms or areas within the property that are restricted to the service provider. At the time of scheduling the service, the resident may provide the restrictions for the area of the property accessible to the service provider. The one or more cameras and one or more sensors monitor the property while the service provider is within the property to ensure that the service provider does not entered a restricted area. In some implementations, when a camera or a sensor detects the service provider enters a restricted area of the property, the control until communicates an alert notification to the resident. In some examples, the alert notification may include a link that when selected allows the resident to view a livestream of video data of the service provider at the property. In some examples, the control unit may generate an audible warning message from a speaker at the property, instructing the service provider to vacate a restricted area. In some implementations, the service provider assigned to a service appointment at the property may be instructed to wear a body camera that records their activity while within the monitored property.

In some implementations, the control unit automatically rearms the monitoring system when the service provider completes the service at the property. The control unit may assume the service at the property is complete based on detecting the entry point to the property is closed and locked, and the electronic device of the service provider is outside of a threshold distance from the property. When the control unit detects that the entry point is closed and locked, the control unit may communicate with the electronic device of the service provider. The control unit determines the service provider has vacated the property, and rearms the monitoring system based on determining that the electronic device of the service provider is outside of the threshold distance from the property.

In some examples, a scheduled service may require a service provider to access the property more than one time to complete a single service. For example, the dog walker has to access the property to pick up the dog and a second time to drop off the dog. In these examples, the control unit may automatically rearm the monitoring system when the dog walker vacates the property with the dog. The control unit may analyze video data to determine that the dog walker and the dog have left the property, and may determine that follow up access is required. The control unit may determine that follow up access is required based on determining that the dog and the dog walker have vacated the property. When the dog walker returns with the dog, the control unit may disarm the monitoring system and allow access to the property based on determining the dog walker and dog have returned. The control unit may analyze video data to determine when the dog walker and the dog have returned, and disarms the monitoring system based on determining that the dog walker is accompanied by the dog. For example, the control unit may generate an alert based on determining that the dog walker returned to the property without the dog. In some examples, when the dog walker and the dog do not return within a predetermined time period, the control unit may communicate an alert notification to the resident to inform the resident that the dog walker has not completed the service.

In some implementations, the control unit confirms the service provider has vacated the property based on sensor data and camera data received from the one or more cameras and one or more sensors located throughout the property. For example, the control unit may analyze video data to confirm that the service provider has vacated the property. The control unit may analyze video data using one or more video analytic techniques to determine whether a service has been completed. For example, the control unit may analyze video data to confirm the gardener's service has been complete based on determining that the grass has been cut and the hedges have been trimmed. The control unit may analyze video data to confirm the grocery delivery service has been complete based on determining that food items have been placed in the refrigerator.

In some implementations, the control unit may confirm the service provider has completed a service using sensor data received from the device that is being serviced. For example, the control unit may confirm the HVAC system is now running normally and may confirm the technician has completed the service on the HVAC system.

In some implementations, where the service involves a physical object, such as a package delivery service, the control unit may determine the service is complete based on an interior camera identifying the package within the property. In these implementations, the control unit may automatically rearm the monitoring system when the interior camera identifies the package, and an exterior camera captures data of the service provider vacating the property.

In some implementations, the control unit automatically rearms the monitoring system when the service provider enters an exit code into the control panel of the monitoring system. In these implementations, the monitor control unit may generate a specific exit code for the service provider. The exit code may be provided to the electronic device of the service provider when the service provider is authenticated and granted access to the property. The service provider may enter the exit code when the services are complete. When the control unit receives the exit code from the service provider, the control unit automatically rearms the monitoring system, and invalidates the exit code for any future use.

In some implementations, the control unit rearms the monitoring system based on the expected service time elapsing. When the user schedules a service appointment with the smart access service, the service appointment may be assigned an expected time for service based on the service. For example for a package delivery, the expected time for service may be two minutes, while the expected time for service for an electrician appointment may be an hour. When the expected time for the scheduled service has elapsed, the control unit may determine the location of the electronic device of the service provider, and may automatically rearm the monitoring system based on determining the service provider is outside of a threshold distance from the property. In some examples, the speaker on the control panel may output a warning message that indicates the amount of time the service providers has to complete the service. For example, the speaker may indicate to the service provider that the provider has fifteen more minutes to complete the task and vacate the property.

For example, if a service provider has 2 minutes to put a package in the house the panel may starting beeping (or issue a verbal warning) when 30 seconds are left on the clock. The beeping could then speed up when 10 seconds are left. I believe some panels can already do this kind of thing for regular arming actions by the home owner, but it would be nice to leverage the feature for in-home deliveries.

In some implementations, when the control unit determines that the location of the electronic device of the service provider is within the monitored property after the expected time for service has elapsed, the control unit generates an alert notification to the resident. In other implementations, when the control unit determines that the location of the electronic device of the service provider is within the monitored property after the expected time for service has elapsed, the control unit generates an audible alarm.

In some implementations, when the control unit rearms the monitoring systems at the completion of a service, the monitoring system may enter a mode where there is a heightened level of unexpected activity detection. When the monitoring system is in this mode, each of the sensors located throughout the property decrease their thresholds for detecting activity. For example, the threshold for detecting motion by a motion detector is lowered so that the slightest motion within the property triggers an alarm condition. In some examples, the control unit may deploy a drone that patrols the one or more rooms of the property, and the one or more speakers may have a heightened audio event detection while in this mode.

In some implementations, the control unit at the property may confirm the location of the security system as one of the factors for authentication of a service. For example, a resident may move residences and may move the one or more cameras, the control unit, and the one or more sensors of the security system to the new residence. The control unit may use one or more different techniques to ensure that the physical location of the property matches the location of the security system to ensure the service is provided to the correct physical location.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system that is configured to monitor a property, the monitoring system comprising:

one or more sensors that are located at the property; and a monitor control unit that is configured to:

receive, from one of the one or more sensors, a biometric identifier from a visitor to the property;

determine an arrival time of the visitor based on receipt of the biometric identifier;

compare the arrival time of the visitor to an expected arrival time of an expected visitor;

based on comparison of the arrival time of the visitor to the expected arrival time, transmit, to an external server, the biometric identifier and data identifying the expected visitor;

receive, from the external server, (i) data indicating that the biometric identifier corresponds to the expected visitor and (ii) data indicating that an electronic device of the expected visitor is located at the property; and based on (i) the data indicating that the biometric identifier corresponds to the expected visitor and (ii) the data indicating that the electronic device of the expected visitor is located at the property, grant the visitor access to the property.

2. The system of claim 1, wherein the monitor control unit is configured to:

receive data identifying an area of the property that the visitor is restricted from entering while the visitor is inside the property;

determine, based on data received from the one or more sensors, that the visitor entered the area of the property that the visitor is restricted from entering; and in response to determining that the visitor entered the area of the property that the visitor is restricted from entering, transmit, to a computing device of a resident of the property, a notification indicating that the visitor entered the area of the property that the visitor is restricted from entering.

3. The system of claim 1, wherein the monitor control unit is configured to:

determine, based on data received from the one or more sensors, that an entry point to the property is closed;

based on determining that the entry point to the property is closed, receive data indicating a location of an electronic device of the visitor;

determine that the location of the electronic device of the visitor is outside of a threshold distance from the property; and based on determining the location of the electronic device of the visitor is outside of the threshold distance from the property, arm the monitoring system.

4. The system of claim 1, wherein the monitor control unit is configured to:

generate an exit code in response to granting the visitor access to the property;

communicate the exit code to the visitor;

receive the exit code; and based on receiving the exit code, arm the monitoring system and invalidate the exit code for subsequent uses.

5. The system of claim 1, wherein the monitor control unit is configured to:

receive data that indicates a time period for the expected visitor to have access to the property;

determine that the time period for the expected visitor to have access to the property has elapsed since granting the visitor access to the property;

based on determining that the time period for the visitor to have access to the property has elapsed since granting the visitor access to the property, receive data indicating a location of an electronic device of the visitor;

determine that the location of the electronic device of the visitor is outside of a threshold distance of the property; and based on determining that the location of the electronic device of the visitor is outside of the threshold distance of the property, arm the monitoring system.

6. The system of claim 1, wherein the monitor control unit is configured to:

receive data that indicates a time period for the expected visitor to have access to the property;

determine that the time period for the expected visitor to have access to the property has elapsed since granting the visitor access to the property;

based on determining that the time period for the visitor to have access to the property has elapsed since granting the visitor access to the property, receive data indicating a location of an electronic device of the visitor;

determine that the location of the electronic device of the visitor is within a threshold distance of the property; and based on determining that the location of the electronic device of the visitor is within the threshold distance of the property, generate a notification indicating that the visitor is within or near the property for longer than expected.

7. The system of claim 6, wherein the monitor control unit is configured to transmit, to a computing device of a resident of the property, the notification indicating that the visitor is within or near the property for longer than expected.

8. The system of claim 6, wherein the monitor control unit is configured to generate a notification indicating that the visitor is within or near the property for longer than expected by outputting an audible alarm.

9. The system of claim 1, wherein the monitor control unit is configured to:

receive data identifying the expected visitor and the expected arrival time of the expected visitor;

communicate, to the external server, data indicating that monitoring system is configured to grant access to the expected visitor upon verification from the external server;

receive, from the external server, data indicating that external server is configured to verify a captured biometric identifier of the expected visitor; and transmit, to the external server, the biometric identifier and data identifying the expected visitor based on receiving the data indicating that third-party server is configured to verify a captured biometric identifier of the expected visitor.

10. The system of claim 1, wherein the monitor control unit is configured to:

grant the visitor access to the property by:

disarming the monitoring system and unlocking an entry point to the property.

11. The system of claim 1, comprising:

a monitoring server that is configured to communicate with the external server and the monitor control unit, wherein the monitoring server is configured to:

receive, from the external server, (i) the data indicating that the biometric identifier corresponds to the expected visitor and (ii) the data indicating that an electronic device of the expected visitor is located at the property; and transmit, to the monitor control unit, (i) the data indicating that the biometric identifier corresponds to the expected visitor and (ii) the data indicating that an electronic device of the expected visitor is located at the property.

12. The system of claim 1, wherein the monitor control unit is configured to:

receive, from the external server, (i) data indicating that the biometric identifier does not correspond to the expected visitor and (ii) data indicating that an electronic device of the expected visitor is located at the property; and based on the (i) data indicating that the biometric identifier does not correspond to the expected visitor and (ii) the data indicating that the electronic device of the expected visitor is located at the property, provide, to a client device of a resident of the property, a notification (i) that indicates the biometric identifier does not correspond to the expected visitor and the electronic device of the expected visitor is located at the property and (ii) that includes a selectable option to grant the visitor access to the property.

13. The system of claim 12, wherein the monitoring control unit is configured to:

receive, from the client device of the resident of the property, data indicating a selection to grant the visitor access to the property; and based on receiving data indicating the selection to grant the visitor access to the property, disarm the monitoring system and unlock an entry way to the property.

14. A computer implemented method, comprising:

receiving, from one of the one or more sensors of a monitoring system that is configured to monitor a property, a biometric identifier from a visitor to the property;

determining, by the monitoring system, an arrival time of the visitor based on receiving the biometric identifier;

comparing, by the monitoring system, the arrival time of the visitor to an expected arrival time of an expected visitor;

based on comparing the arrival time of the visitor to an expected arrival time, transmitting, by the monitoring system and to an external server, the biometric identifier and data identifying the expected visitor;

receiving, by the monitoring system and from the external server, (i) data indicating that the biometric identifier corresponds to the expected visitor and (ii) data indicating that an electronic device of the expected visitor is located at the property; and based on (i) the data indicating that the biometric identifier corresponds to the expected visitor and (ii) the data indicating that the electronic device of the expected visitor is located at the property, granting, by the monitoring system, the visitor access to the property.

15. The method of claim 14, comprising:

receiving data identifying an area of the property that the visitor is restricted from entering while the visitor is inside the property;

determining based on data received from the one or more sensors, that the visitor entered the area of the property that the visitor is restricted from entering; and in response to determining that the visitor entered the area of the property that the visitor is restricted from entering, transmitting, to a computing device of a resident of the property, a notification indicating that the visitor entered the area of the property that the visitor is restricted from entering.

16. The method of claim 14, comprising:

determining, based on data received from the one or more sensors, that an entry point to the property is closed;

based on determining that the entry point to the property is closed, receiving data indicating a location of an electronic device of the visitor;

determining that the location of the electronic device of the visitor is outside of a threshold distance from the property; and based on determining the location of the electronic device of the visitor is outside of the threshold distance from the property, arming the monitoring system.

17. The method of claim 14, comprising:

generating an exit code in response to granting the visitor access to the property;

communicating the exit code to the visitor;

receiving the exit code; and based on receiving the exit code, arming the monitoring system and invalidate the exit code for subsequent uses.

18. The method of claim 14, comprising:

receiving data that indicates a time period for the expected visitor to have access to the property;

determining that the time period for the expected visitor to have access to the property has elapsed since granting the visitor access to the property;

based on determining that the time period for the visitor to have access to the property has elapsed since granting the visitor access to the property, receiving data indicating a location of an electronic device of the visitor;

determining that the location of the electronic device of the visitor is outside of a threshold distance of the property; and based on determining that the location of the electronic device of the visitor is outside of the threshold distance of the property, arming the monitoring system.

19. The method of claim of claim 14, comprising:

receiving data that indicates a time period for the expected visitor to have access to the property;

determining that the time period for the expected visitor to have access to the property has elapsed since granting the visitor access to the property;

based on determining that the time period for the visitor to have access to the property has elapsed since granting the visitor access to the property, receiving data indicating a location of an electronic device of the visitor;

determining that the location of the electronic device of the visitor is within a threshold distance of the property; and based on determining that the location of the electronic device of the visitor is within the threshold distance of the property, generating a notification indicating that the visitor is within or near the property for longer than expected.

20. The method of claim 19, further comprising:

transmitting, to a computing device of a resident of the property, the notification indicating that the visitor is within or near the property for longer than expected.

* * * * *